US005560291A

United States Patent [19]

Shu

[11] Patent Number: 5,560,291

[45] Date of Patent: Oct. 1, 1996

[54] STAMPING MACHINE

[76] Inventor: Ming Fang Shu, No. 32, Lane 375, Hua Cheng Road, Shin Chaung City, Taipei, Taiwan

[21] Appl. No.: 525,014

[22] Filed: Sep. 20, 1995

[51] Int. Cl.[6] ..... B41F 17/00

[52] U.S. Cl. ..... 101/41; 101/379

[58] Field of Search ..... 101/379, 327, 101/333, 368, 493, 35, 41, 163

[56] References Cited

U.S. PATENT DOCUMENTS

| | | | |
|---|---|---|---|
| 4,060,031 | 11/1977 | Philipp | 101/163 |
| 4,962,703 | 10/1990 | Bishop | 101/334 |
| 5,042,382 | 8/1991 | Yamazaki et al. | 101/379 |
| 5,088,401 | 2/1992 | Fujino et al. | 101/41 |
| 5,272,973 | 12/1993 | Chojnacki | 101/163 |
| 5,392,706 | 2/1995 | Drew, II et al. | 101/163 |
| 5,430,286 | 7/1995 | Samuels | 101/163 |
| 5,476,040 | 12/1995 | Kleist | 101/163 |

*Primary Examiner*—Eugene H. Eickholt
*Attorney, Agent, or Firm*—Bacon & Thomas

[57] ABSTRACT

A stamping machine including a rubber stamping head angular position adjustment mechanism, which can be adjusted to the desired angular position for stamping different workpieces, a horizontal slide adjustment mechanism, which can be adjusted to move the rubber stamping head to the desired horizontal position, an automatic ink feeder, which can be adjusted to supply metered quantity of ink, a scraper carrier, which keeps the scraper blade and the ink application roller unit operated at the same elevation, an ink tray assembly, which is detachable, and a workpiece conveying mechanism, which uses a driving wheel driven by an air cylinder through a rack and a gear to turn a conveying chain in carrying a series of workpiece table plates for a continuous stamping operation.

4 Claims, 22 Drawing Sheets

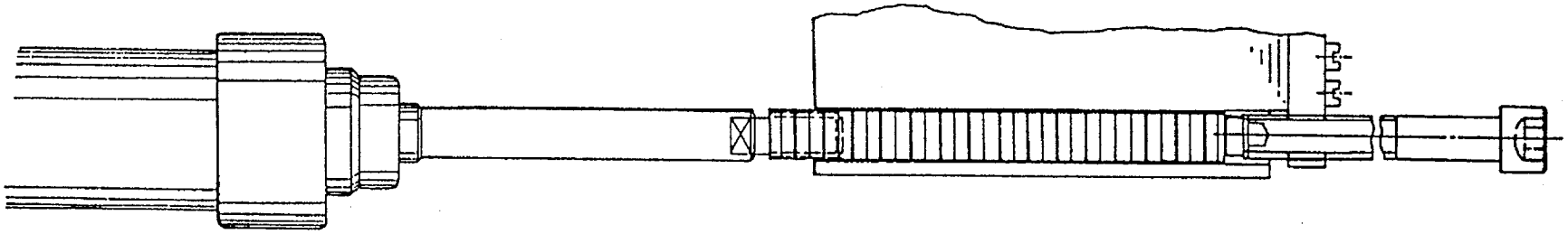
FIG. 24-A
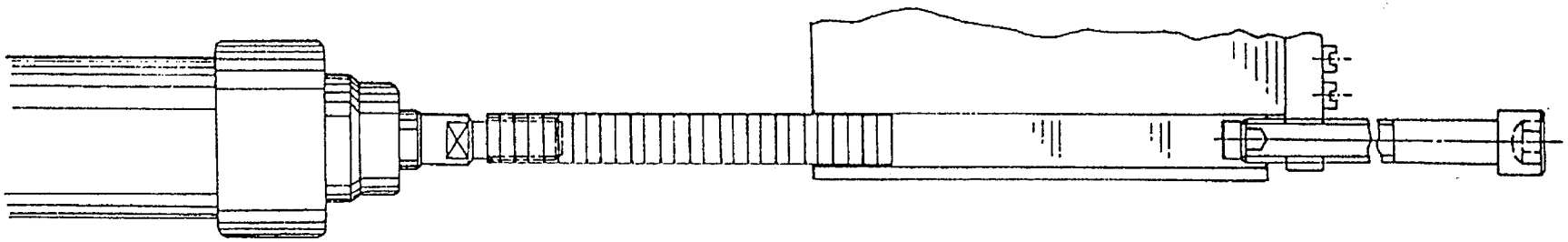
FIG. 24-B

STAMPING MACHINE

BACKGROUND OF THE INVENTION

The present invention relates to stamping machines, and relates more particularly to such a stamping machine for stamping trademarks, logos, patterns, etc., on products.

FIG. 1 shows a stamping machine for stamping trademarks, logos, patterns, etc., on products. This conventional structure of stamping machine is still not satisfactory in function and have various drawbacks as outlined hereinafter.

1. With respect to the rubber stamping head:

The rubber stamping head is fixedly secured in place when installed, and reciprocated in vertical during stamping. Therefore, the rubber stamping head is applicable for stamping a specific kind of products. For stamping different products, different rubber stamping heads shall be used.

2. With respect to the slide which carries the rubber stamping head:

The slide is moved properly as: vertically downwards to stamp on the workpiece→vertically upwards to leave from the workpiece→horizontally backwards to the ink tray→vertically downwards to dip in ink→vertically upwards from the ink tray, horizontally forwards to the stamping position. During the operation of the slide, the distances of the horizontal and vertical strokes are not adjustable. However, because different workpieces have different sizes, the position of each workpiece of different size must be properly adjusted to fit the stamping action of the rubber stamping head. However, it is complicated to adjust the position of each workpiece subject to its size.

3. With respect to the ink feeder:

The supply of ink is manually operated by the operator. When the printing machine is operated, the operator must carefully watch the consumption of ink and keep supplying ink to the ink tray properly. If the concentration of ink is not properly controlled, stamping errors will occur soon.

4. With respect to the scraper carrier:

The scrapper carrier is not detachable, therefore the maintenance work is complicated to perform, and the stamping operation is complicated when color printing is required; the position of the scraper blade cannot be lowered, therefore the scraper blade tends to be damaged during the operation; the scraper carrier tends to vibrate during the operation; the scraper blade and the ink application brush cannot be operated at the same elevation; the ink brush is to supply ink in a vertical direction but not in a horizontal direction, therefore ink cannot be evenly supplied; the scraper holder and the ink brush holder tend to be jammed in ink during the operation; the scraper holder and the ink brush holder are separately installed and tend to be damaged easily; the ink brush of the ink applicator cannot evenly supply ink; the ink applicator is difficult to clean and maintain; the ink brush must be regularly replaced; ink tends to be splashed to contaminate the printing machine and the workpieces during the operation; the ink application wheel achieves only a limited printing area.

5. With respect to the ink tray assembly:

The side-loading design of the ink tray complicates the installation of the ink tray assembly, the scraper holder, and the ink brush holder; because of the deep design of the ink tray, ink tends to be splashed out of the ink tray assembly, and the ink tray assembly tends to be stuck by ink; the locating steel plate tends to deform, causing the application of ink affected; the ink tray is made of aluminum alloy, which tends to react with ink and solvent, and to affect the printing quality; the cleaning work of the ink tray assembly is difficult to perform because it cannot be conveniently dismantled.

6. With respect to the workpiece conveying mechanism:

The workpiece conveying mechanism, as shown in FIG. 2, comprises an air cylinder 1, a rectangular block 11 reciprocated by the air cylinder 1. The rectangular block 11 has two triangular projecting strips 111 supported on a respective spring at the top side for moving the workpiece table plate 2. When the rectangular block 11 is moved forwards, the triangular projecting strips 111 force a first workpiece table plate 2 forwards. When the rectangular block 11 is moved backwards, the triangular projecting strips 111 are forced downwards by a second workpiece table plate 2. When the rectangular block 11 passes over the second workpiece table plate 2, the triangular projecting strips 111 are forced upwards to their former positions by the respective springs for forwarding a nest workpiece table plate.

SUMMARY OF THE INVENTION

The present invention has been accomplished to provide a stamping machine which eliminates the aforesaid drawbacks. It is one object of the present invention to provide a rubber stamping head angular position adjustment mechanism for a stamping machine which allows the rubber stamping head to be adjusted to the desired angular position for stamping different workpieces.

It is another object of the present invention to provide a horizontal slide adjustment mechanism for a stamping machine which permits the reciprocating distance of the slide, which carries the rubber stamping head, to be conveniently adjusted to fit different workpieces.

It is still another object of the present invention to provide an automatic ink feeder for a stamping machine which can be conveniently adjusted to automatically regularly supply metered quantity of ink.

It is still another object of the present invention to provide a scraper carrier for a stamping machine which keeps the scraper blade and the ink application roller unit operated at the same elevation for a high quality color printing.

It is still another object of the present invention to provide an ink tray assembly for a stamping machine which is detachable, and which permits the ink tray to be quickly installed.

It is till another object of the present invention to provide a workpiece conveying mechanism for a stamping machine which uses a driving wheel driven by an air cylinder through a rack and a gear to turn a conveying chain in carrying a series of workpiece table plates for a continuous stamping operation.

BRIEF DESCRIPTION OF THE DRAWINGS

FIG. 13-1 is a sectional view of the automatic ink feeder according to the present invention, showing the round rod forced out of the screw cap and the ink passage opened;

FIG. 13-2 is similar to FIG. 13-1 but showing the round rod forced into the horizontal through hole of the rectangular holder plate and the ink passage stopped;

FIG. 14-1 is similar to FIG. 13-1 but showing the screw cap turned outwards, and the ink passage relatively enlarged;

FIG. 14-2 is similar to FIG. 14-1 but showing the round rod forced into the horizontal through hole of the rectangular holder plate and the ink passage stopped;

FIG. 24A shows the forward stroke of the workpiece conveying mechanism according to the present invention; and FIG. 24B shows the backward stroke of the workpiece conveying mechanism according to the present invention.

DETAILED DESCRIPTION OF THE PREFERRED EMBODIMENT

Figure 3:
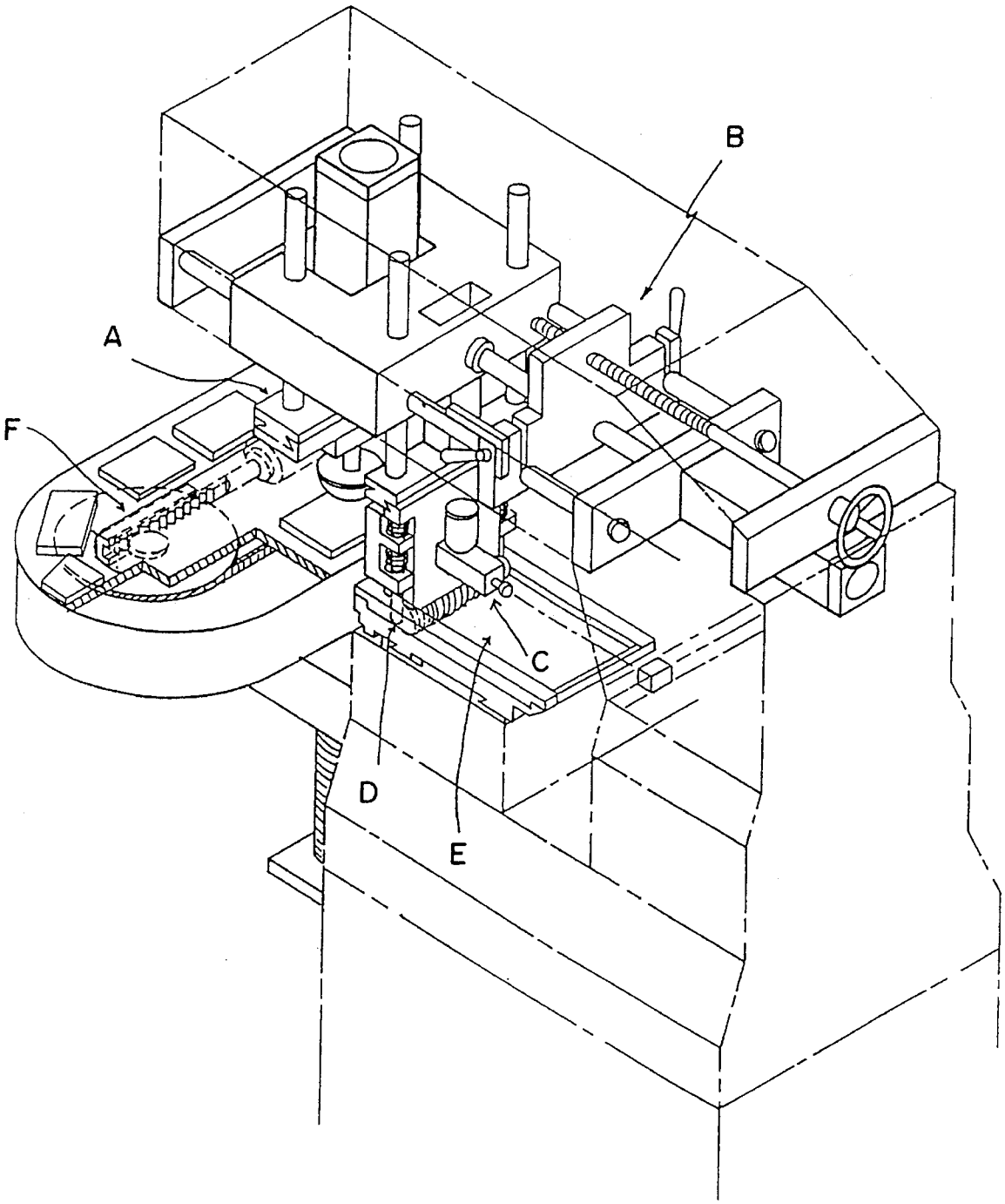
FIG. 3 is a perspective view of the present invention.

Referring to FIG. 3, the present invention is generally comprised of a rubber stamping head angular position adjustment mechanism A, a horizontal slide adjustment mechanism B, an automatic ink feeder C, a scrapper carrier D, an ink tray assembly E, and a workpiece conveying mechanism F.

Figure 4:
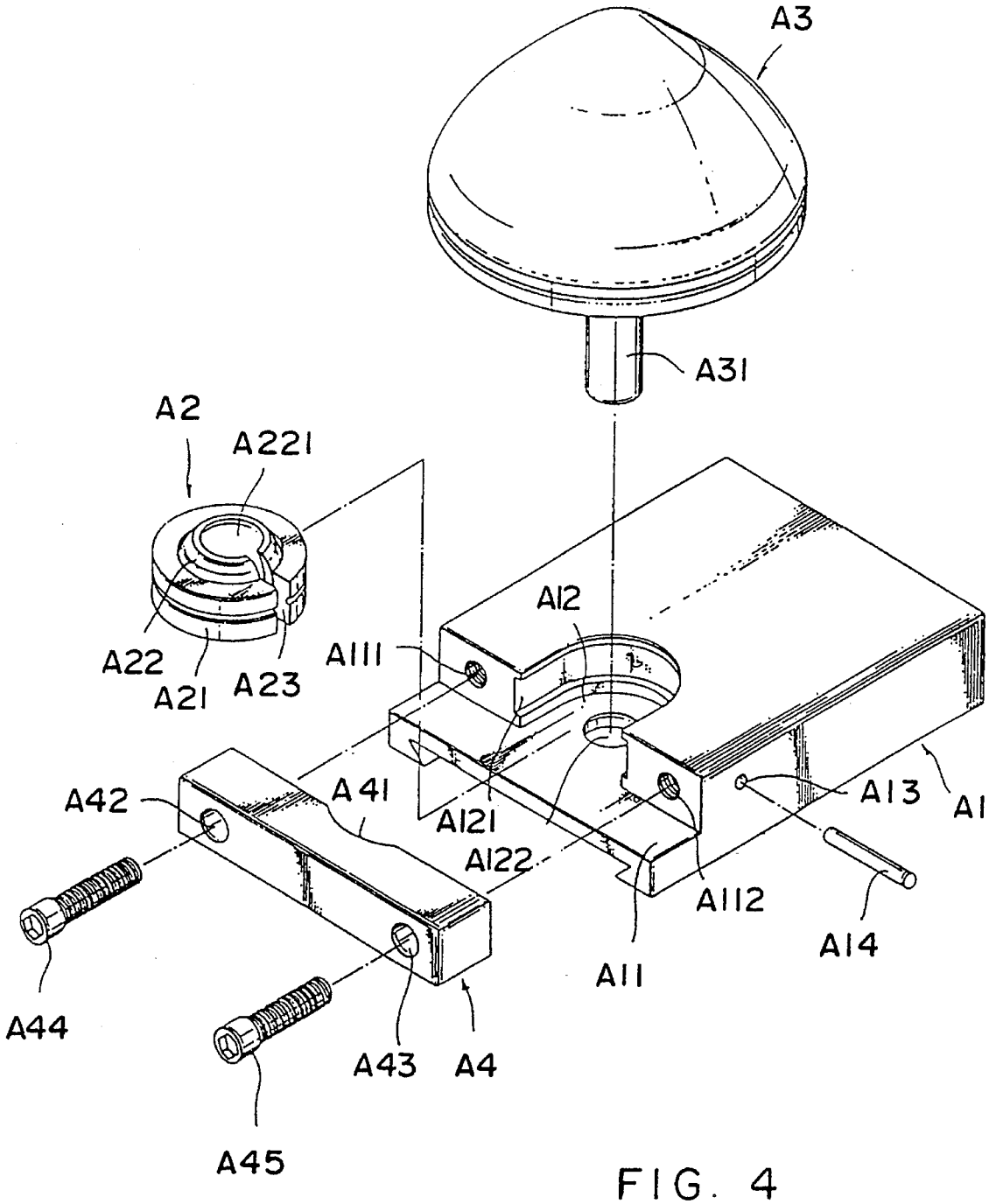
FIG. 4 is an exploded view of the rubber stamping head adjustment mechanism according to the present invention.
Figure 5:
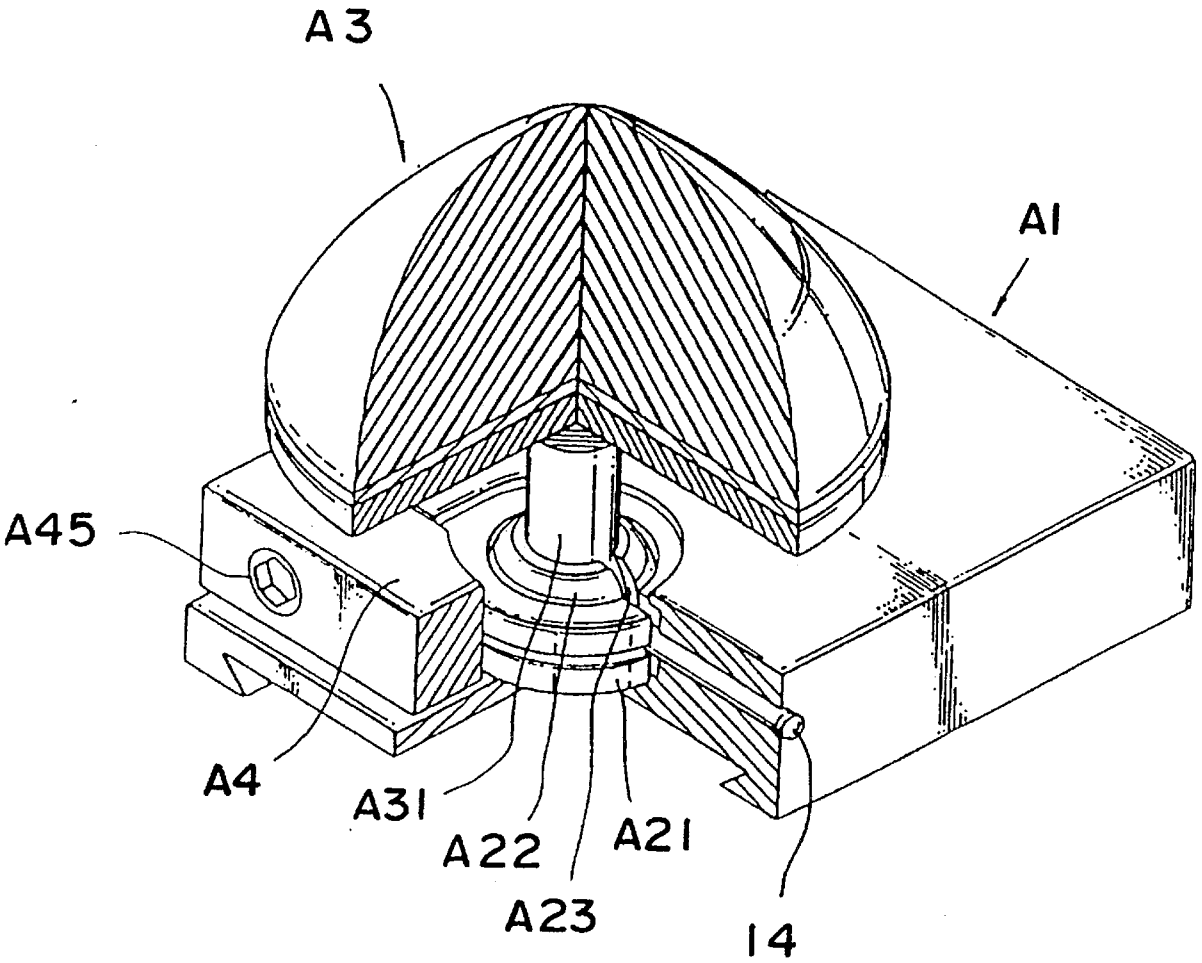
FIG. 5 is a cutaway of the rubber stamping head adjustment mechanism shown in FIG. 4.
Figure 6:
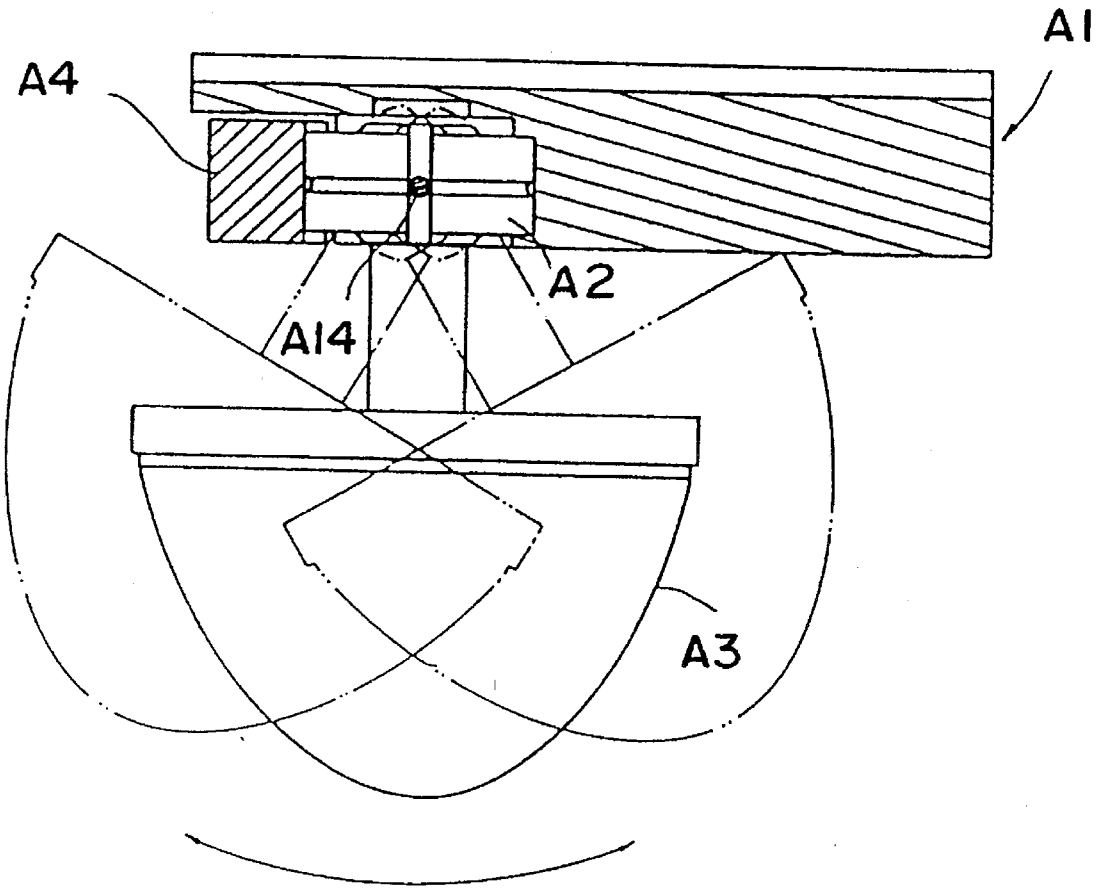
FIG. 6 is a schematic drawing of the rubber stamping head adjustment mechanism according to the present invention, showing the angular position of the rubber stamping head adjusted.

Referring to FIGS. 4, 5, and 6, the rubber stamping head angular position adjustment mechanism A comprises a base plate A1, a universal joint A2, a rubber stamping head A3, and a locating bar A4. The base plate A1 comprises a flat rectangular top recess A11 at the front side, two horizontal screw holes A111 and A112 on the vertical side wall of the flat rectangular top recess A11, a U-shaped top recess A12 disposed between the horizontal screw holes A111 and A112 in communication with the flat rectangular top recess A11, a groove A121 on the periphery of the U-shaped top recess A12, a round hole A122 at the center of the bottom of the U-shaped top recess A12, a pin hole A13 disposed at one lateral side perpendicularly through the groove A121, and a pin A14 inserted into the pin hole A13. The universal joint A2 comprises an annular bearing A21, and a ball A22 turned within the annular bearing A21. A side notch A23 is made through the annular bearing A21 and a part of the ball A22. An axle hole A221 is made through the ball A22. The rubber stamping head A3 has a shank A31 for insertion into the axle hole A221 of the ball A22. During the assembly process, the universal joint A2 is horizontally fitted into the groove A121 of the U-shaped top recess A12 with side notch A23 disposed in alignment with the pin hole A13 and the axle hole A221 in alignment with the round hole A122, then the shank A31 of the rubber stamping head A3 is inserted through the axle hole A221 of the ball A22. Before the shank A31 is inserted into the round hole A122 of the base plate A1, the rubber stamping head A3 can be oscillated to turn the ball A22 within the annular bearing A21 without deviating the side notch A23 from the pin hole A13. When the rubber stamping head A3 is adjusted to the desired tilted position relative to the annular bearing A21 and the base plate A1, the pin A14 is inserted through the pin hole A13 into the side notch A23 to stop the ball A22 in position, and therefore the rubber stamping head A3 is fixed at the desired tilted position. When the angular position of the rubber stamping head A3 is set, the locating bar A4 is fastened to the screw holes A111 and A112 to fill up the flat rectangular top recess A11 and to hold down the annular bearing A21 of the universal joint A2. The locating bar A4 has two through holes A42 and A43 respectively connected to the screw holes A111 and A112 of the base plate A1 by screws A44 and A45, and a circularly arched recess A41 at a back side fitting the periphery of the annular bearing A21 of the universal joint A2. As illustrated in FIG. 5, the rubber stamping head A3 has a tapered stamping surface of different diameters for stamping a variety of workpieces. For a vertical stamping, the shank A31 is inserted into the round hole A122 of the base plate A1, and then fixed in position by the pin A14 (see FIG. 6).

Figure 7:
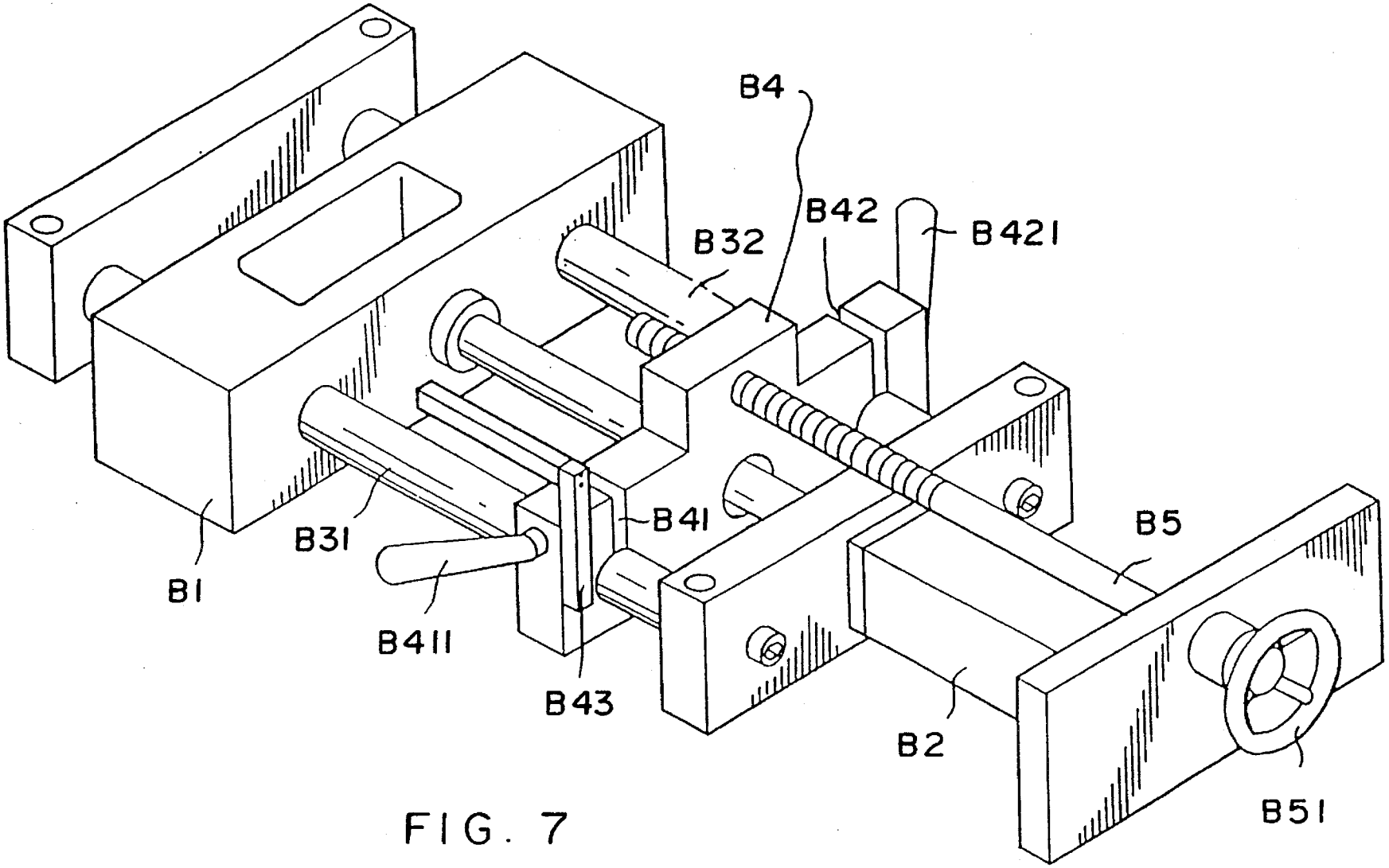
FIG. 7 is an elevational view of the horizontal slide adjustment mechanism according to the present invention.
Figure 8:
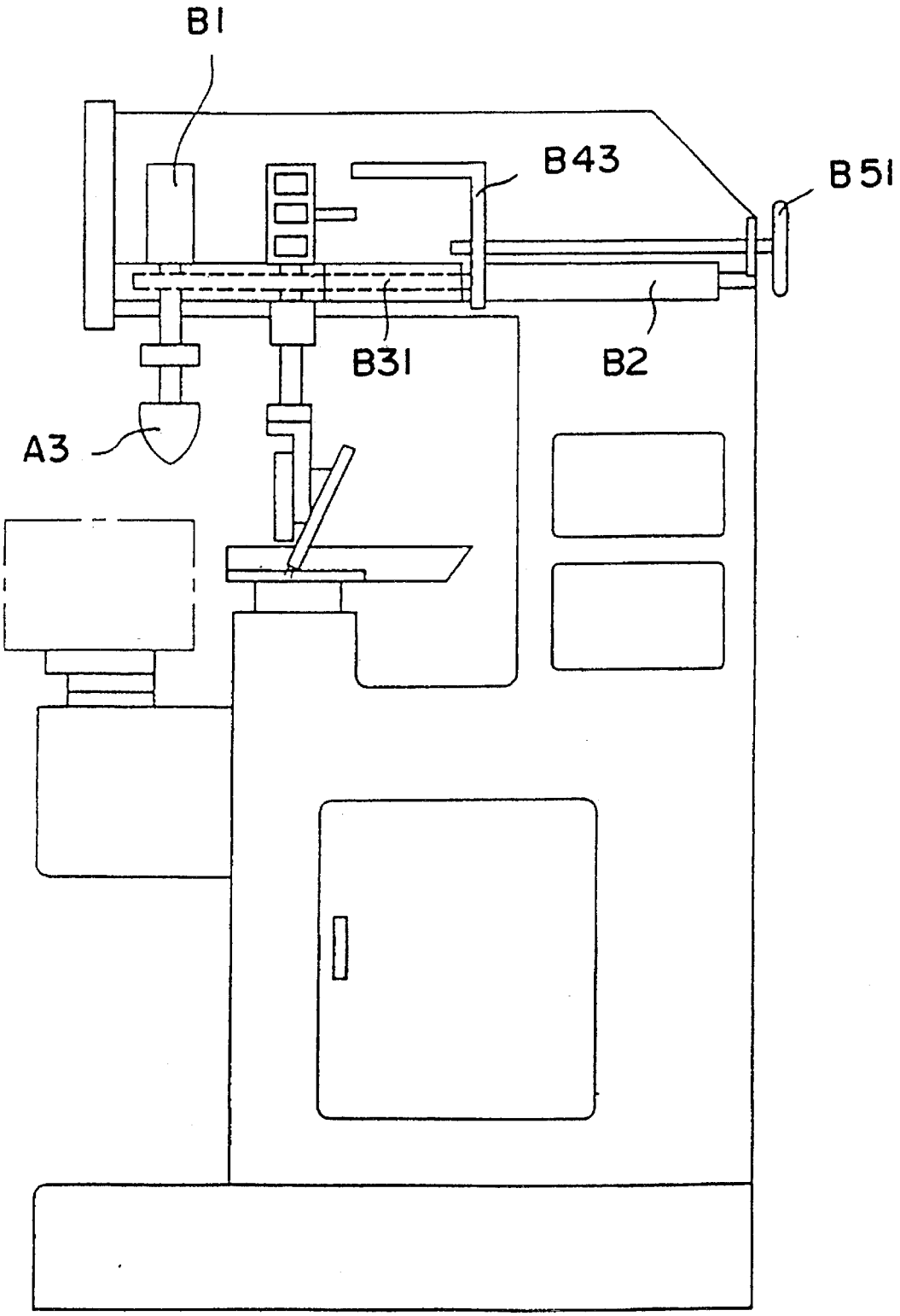
FIG. 8 is a side view showing the horizontal slide adjustment mechanism of FIG. 7 installed in the stamping machine.
Figure 10:
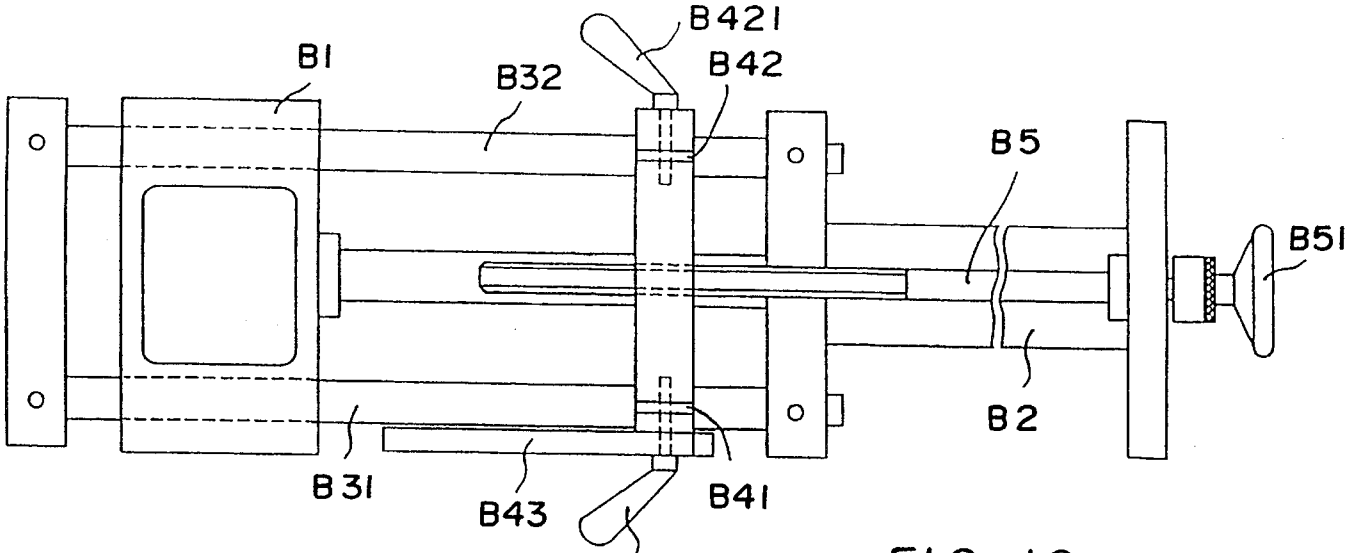
FIG. 10 shows the stroke control block of the horizontal slide adjustment mechanism adjusted backwards from the rubber stamping head slide according to the present invention.
Figure 9:
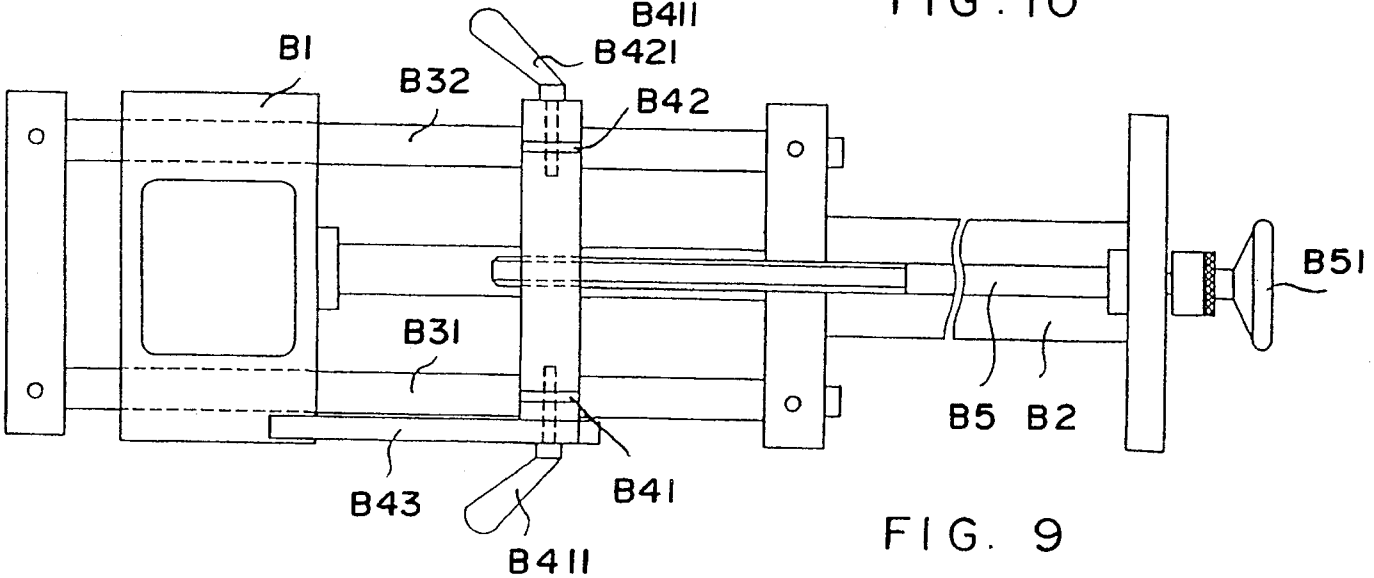
FIG. 9 shows the stroke control block of the horizontal slide adjustment mechanism adjusted forwards toward the rubber stamping head slide according to the present invention.

Referring to FIGS. 7 and 8, the horizontal slide adjustment mechanism B comprises two horizontal parallel rails B31 and B32, a rubber stamping head slide B1 mounted on the horizontal parallel rails B31 and B32 to carry the rubber stamping head angular position adjustment mechanism A, an air cylinder B2 controlled to reciprocate the rubber stamping head slide B1 on the horizontal parallel rails B31 and B32, a stroke control block B4 mounted on the horizontal parallel rails B31 and B32, a screw rod B5 fastened to the block B4 and extended out of the stamping machine, a hand wheel B51 coupled to the screw rod B5 for turning the screw rod B5 to move the stroke control block B4 along the horizontal parallel rails B31 and B32. The stroke control block B4 comprises two notches B41 and B42 respectively extended to the horizontal parallel rails B31 and B32, two holding-down handles B411 and B421 respectively connected to the notches B41 and B42, and a stop bar B43. When the stroke control block B4 is moved on the horizontal parallel rails B31 and B32 by the screw rod B5 to the desired position, the holding-down handles B411 and B421 are turned to the locking position to lock the stroke control block B4 in position so that the stroke control block B4 controls the horizontal reciprocating stroke of the rubber stamping head slide B1. The stop bar B43 is mounted with a micro-switch (not shown). When the rubber stamping head slide B1 touches the micro-switch on the stop bar B43, the air cylinder B2 is stopped to hold the rubber stamping head slide B1 in position. By turning the hand wheel B51 to move the stroke control block B4 toward the rubber stamping head slide B1, as shown in FIG. 9, the horizontal stroke of the rubber stamping head A3 is relatively shortened. On the contrary, when the stroke control block B4 is moved in the reversed direction as shown in FIG. 10, the horizontal stroke of the rubber stamping head A3 is relatively increased.

Figure 11:
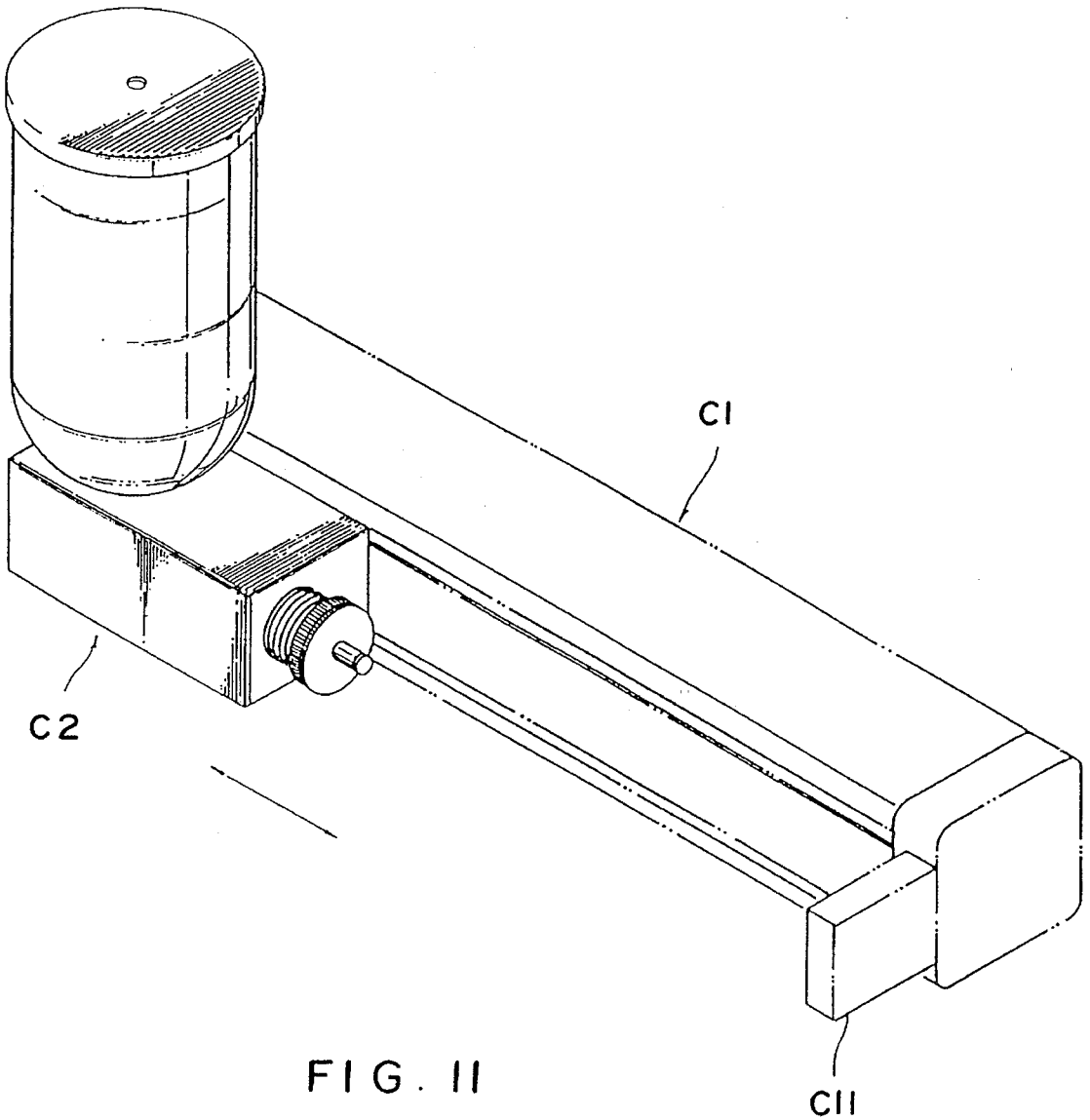
FIG. 11 is an elevational view of the automatic ink feeder according to the present invention.
Figure 12:
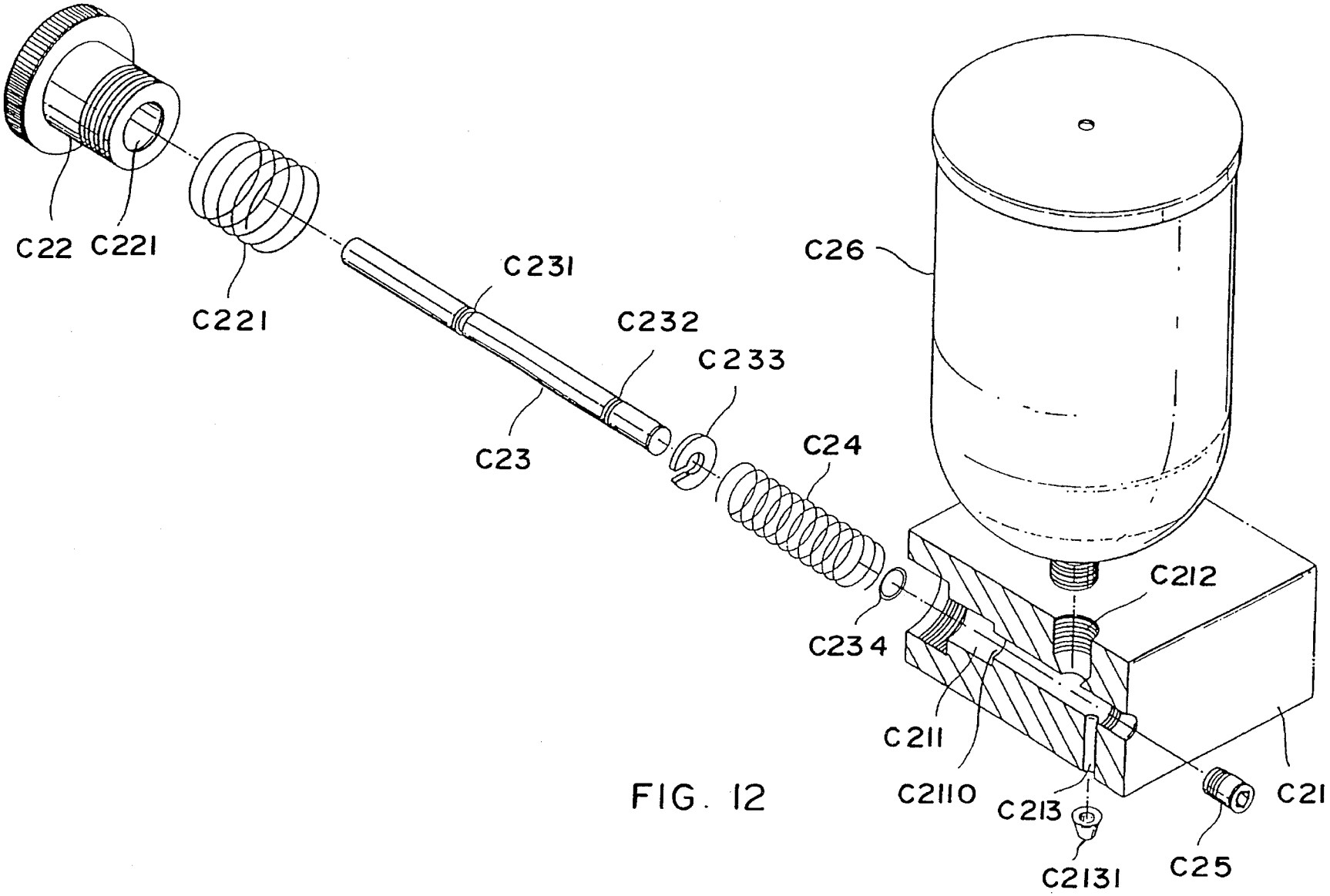
FIG. 12 is an exploded view of the automatic ink feeder shown in FIG. 11.
Figures 2, 13:
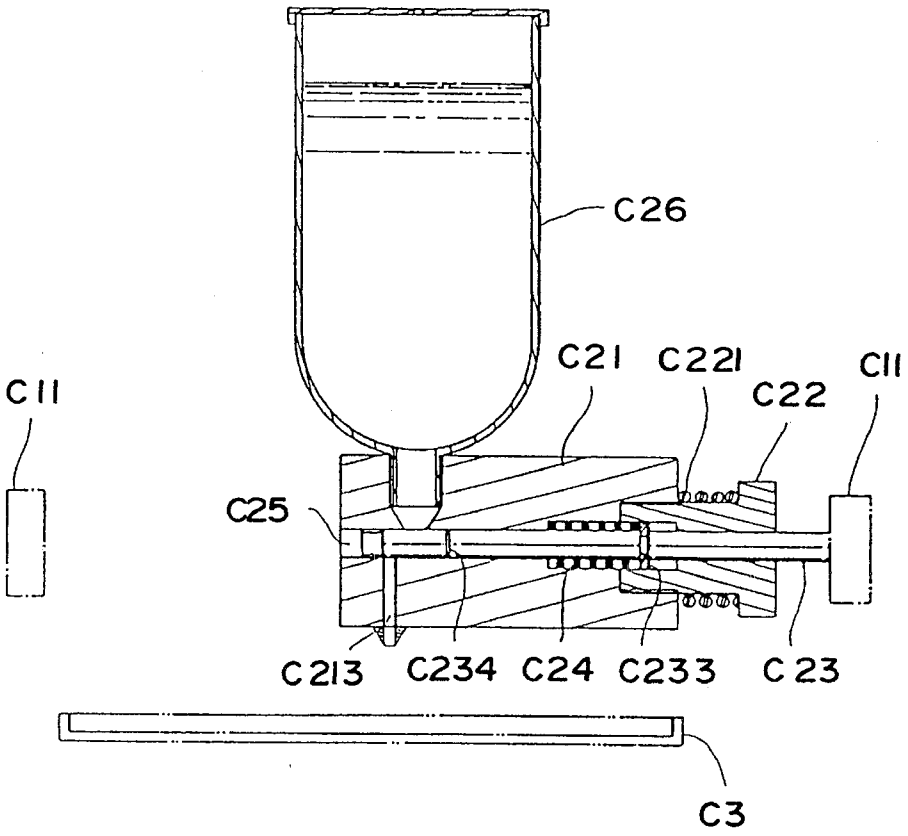
Figures 1, 13:
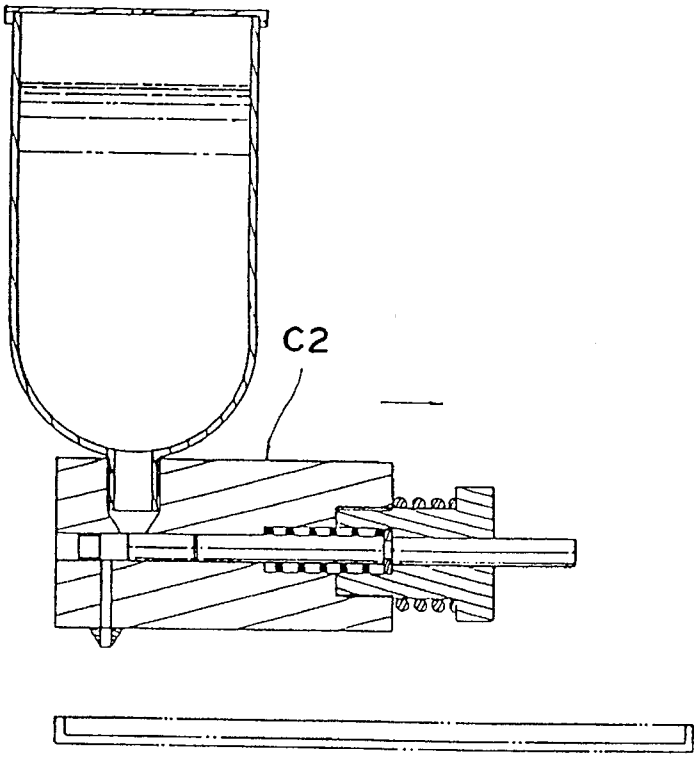
Figures 2, 14:
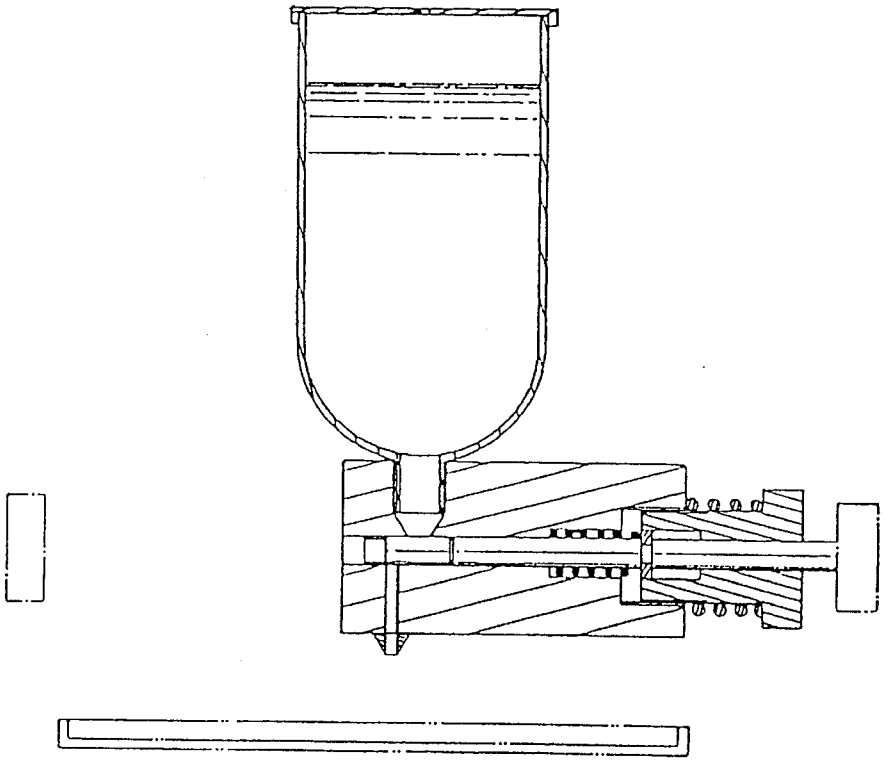
Figures 1, 14:
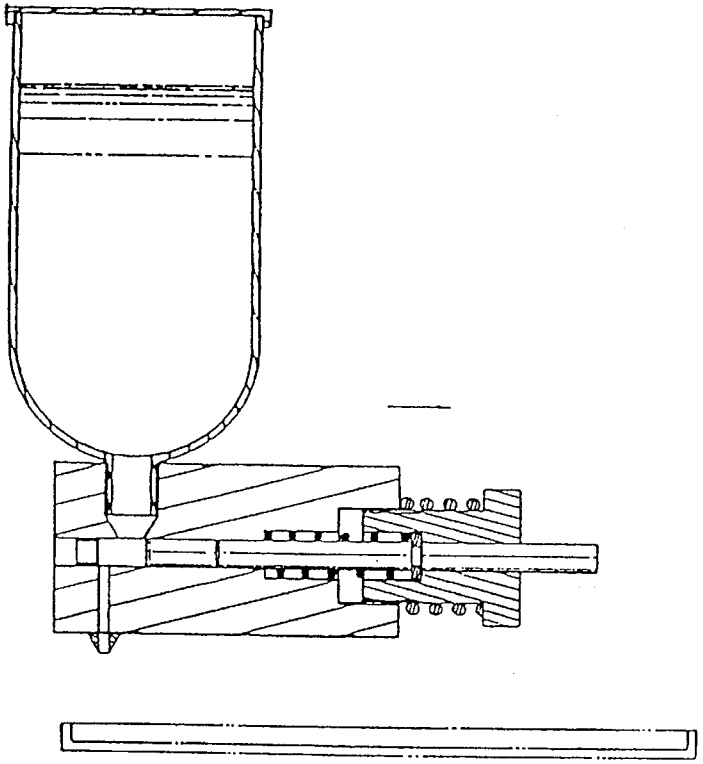

Referring to FIGS. 11, 12, and 13, the automatic ink feeder C comprises a reciprocating mechanism C1, and a ink feeder C2 reciprocated by the reciprocating mechanism C1. The reciprocating mechanism C1 has a stop block C11 at one side for stopping the ink feeder C2 in place. The ink feeder C2 comprises a rectangular holder plate C21, which has a threaded, stepped horizontal through hole C211, a vertical screw hole C212 perpendicularly connected to the horizontal through hole C211 at the top side, and a vertical ink outlet C213 perpendicularly connected to the horizontal through hole C211 at the bottom side, a tapered ink nozzle C2131 fastened to the bottom end of the ink outlet C213, an ink tank C26 fastened to the vertical screw hole C212, a screw cap C22 and an externally threaded hexagonal socket C25 respectively threaded into two opposite ends of the horizontal through hole C211, a round rod C23 inserted through the center through hole C221 of the screw cap C22 into the horizontal through hole C211 and stopped against the hexagonal socket C25 and having a first annular grooves C231 and a second annular groove C232 around the periphery, a metal clamp C233 fastened to the first annular groove C231, a rubber sealing ring C234 fastened to the second annular groove C232, a first compression spring C24 mounted around the round rod C23 and stopped between the metal clamp C233 and a step C2110 in the horizontal through hole C211, a second compression spring C221 mounted around the screw cap C22 and stopped outside the rectangular holder plate C21. The aforesaid vertical through hole C213 is spaced between the vertical screw hole C212 and the internally threaded hexagonal socket C25.

Figure 1:
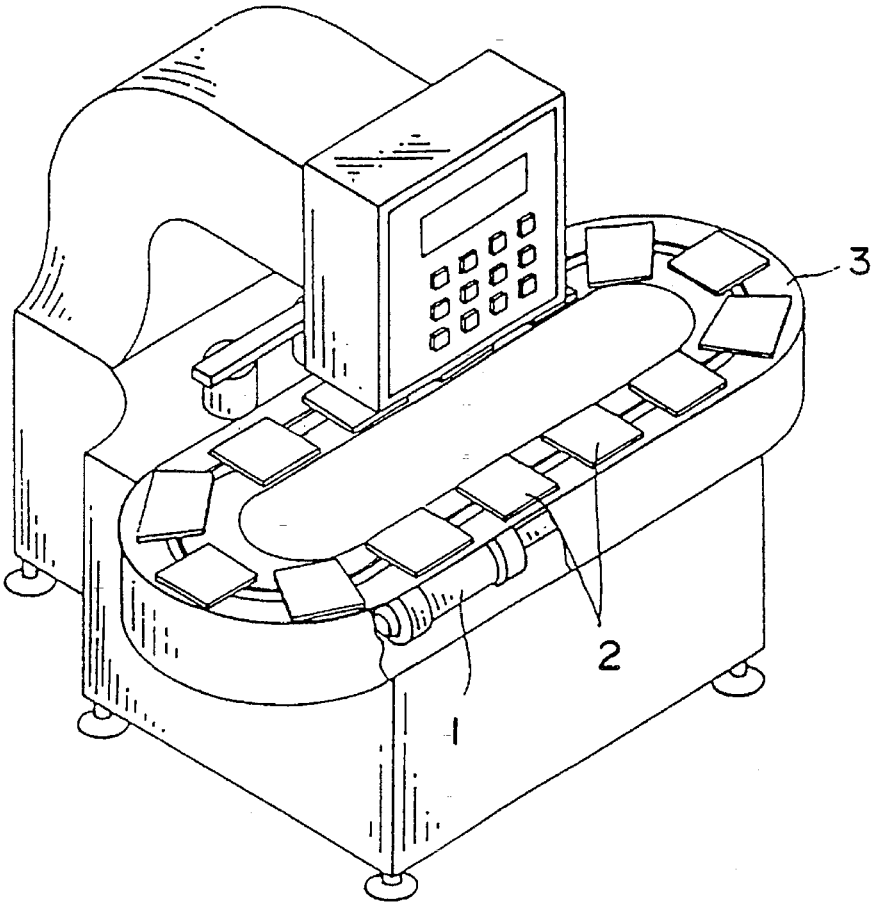
FIG. 1 PRIOR ART
FIG. 1 shows a stamping machine according to the prior art.

Referring to FIG. 13-1, when the ink feeder C2 is moved apart from the stop block C11 of the reciprocating mechanism C1, the round rod C23 is forced away from the hexagonal socket C25 out of the screw cap C22 by the first compression spring C24 to partially open the vertical screw hole C212, therefore ink is allowed to pass from the ink tank C26 through the vertical screw hole C212 and the horizontal through hole C211 into the vertical ink outlet C213.

Figure 2:
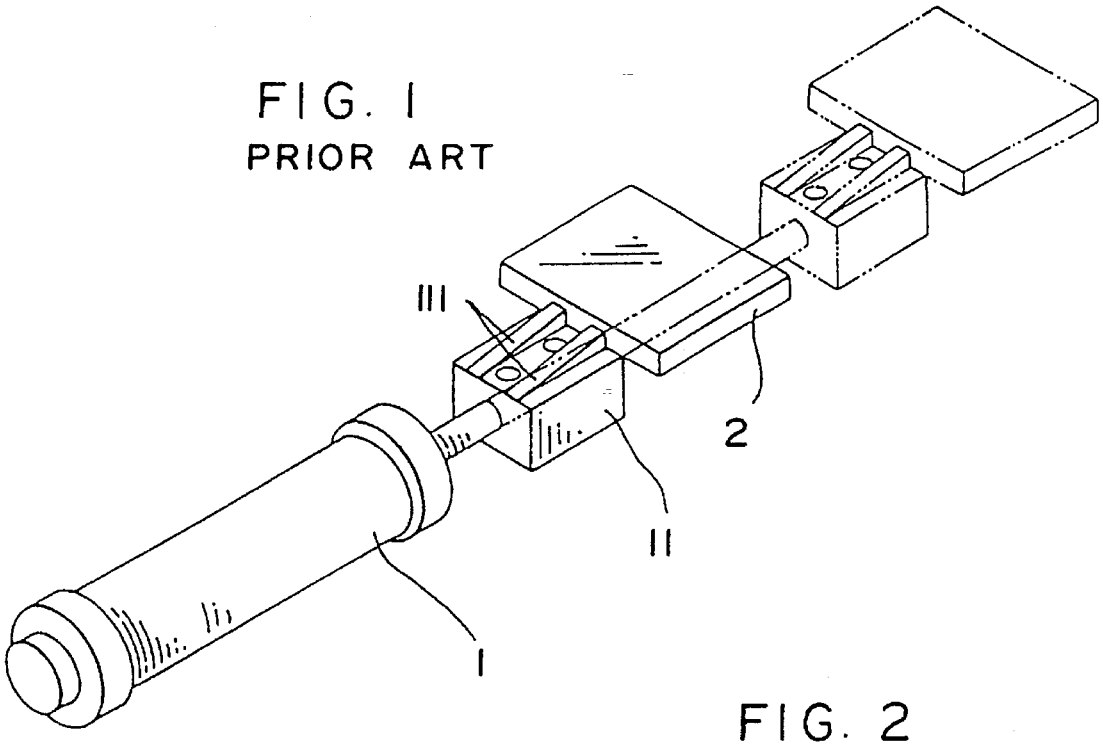
FIG. 2 PRIOR ART
FIG. 2 shows the workpiece conveying mechanism of the stamping machine shown in FIG. 1.

Referring to FIG. 13-2, when the ink feeder C2 is moved to the right limit to stop the round rod C23 against the stop block C11, the round rod C23 is forced back into the horizontal through hole C211 to stop against the hexagonal socket C25 and to block the vertical screw hole C212, and at the same time accumulated ink in the horizontal through hole C211 is squeezed out of the vertical ink outlet C213 through the tapered ink nozzle C2131 into an ink dish C3 below. When the ink feeder C2 is moved leftwards from the stop block C11, the round rod C23 is forced out of the screw cap C22 by the first compression spring C24 and returned to the position of FIG. 13-1 again. When the ink feeder C2 is reciprocated again and again, ink is regularly fed to the ink dish C3.

Figure 15:
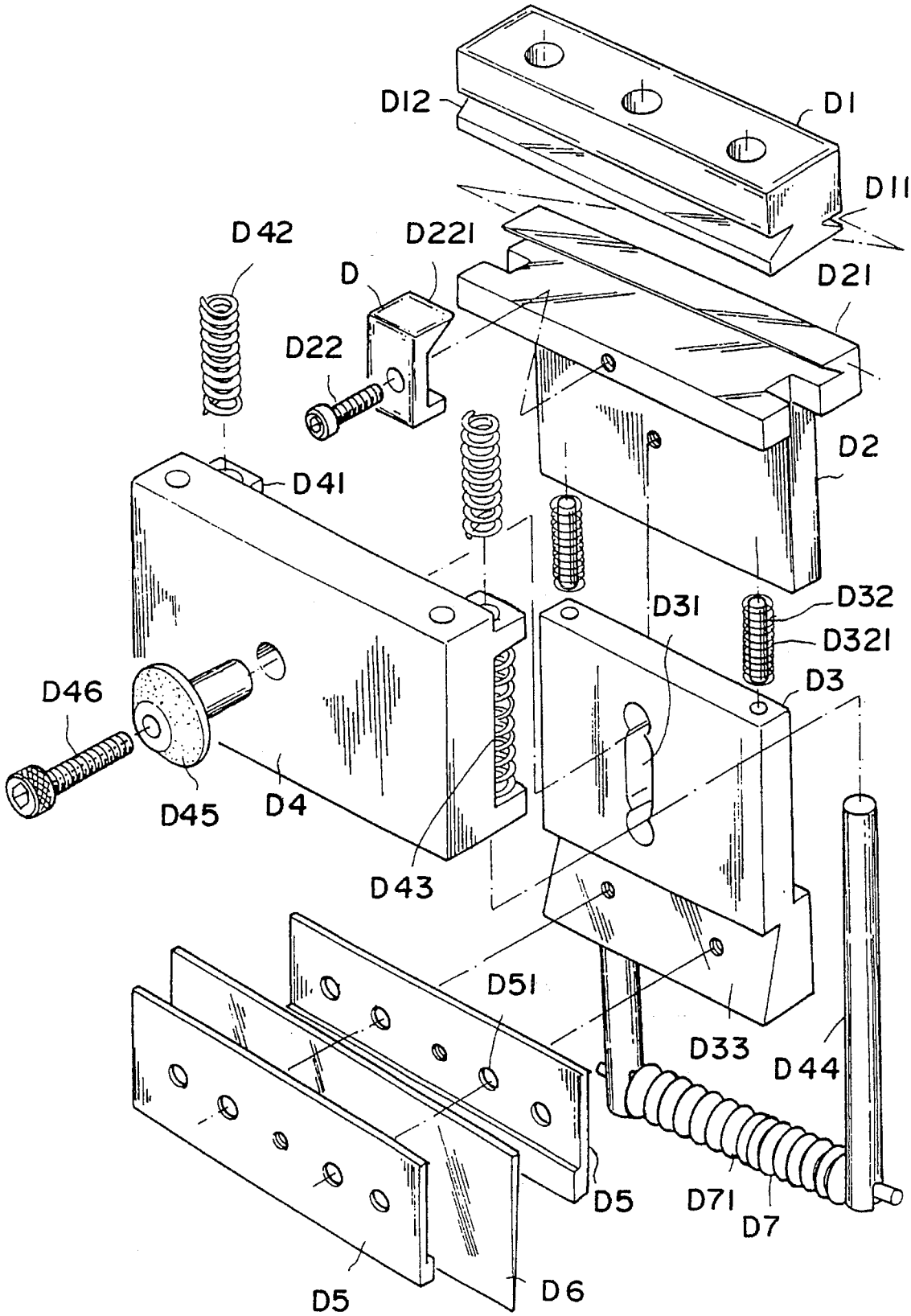
FIG. 15 is an exploded view of the scrapper carrier according to the present invention.

Referring to FIG. 15, the scrapper carrier D comprises a substantially rectangular sliding block D1 having a first dovetail groove D11 and a second dovetail groove D12 longitudinally disposed at two opposite sides at different elevations, a substantially L-shaped supporting plate D2 having a dovetail tongue D21 longitudinally disposed at the top and fitted into the first dovetail groove D11 of the sliding block D1, a locating block D22 fixedly secured to the supporting plate D2 by a screw and having a dovetail tongue D211 at the top side fitted into the second dovetail groove D12 of the sliding block D1, a rack D3 having a peanut-like adjusting hole D31 in the middle, a plurality of movable rods D32 vertically disposed at the top and stopped below the top side of the supporting plate D2, a plurality of compression springs D321 respectively mounted around the movable rods D32, and a downward sloping wall D33 at the bottom, two scraper blade holder plates D5 having mounting holes D51 respectively connected together and fastened to the downward sloping wall D33 of the rack D3, a scraper blade D6 secured to the scraper blade holder plate D5, a cover plate D4 fastened to the adjusting hole D31 by a cushion D45 and a screw D46, having two pairs of back lugs D41 bilaterally raised from the back side, two first compression springs D42 stopped between the back lugs D41 and the top side of the supporting plate D2, and two second compression springs D43 respectively supported between each pair of back lugs D41, a substantially U-shaped bar D44 having two opposite ends respectively inserted into the back lugs D41 and the second compression springs D43, and an ink application roller unit D7 comprised of two reversed series of tapered rollers mounted on the ink application bar D44 at the bottom at the same elevation.

Figure 16:
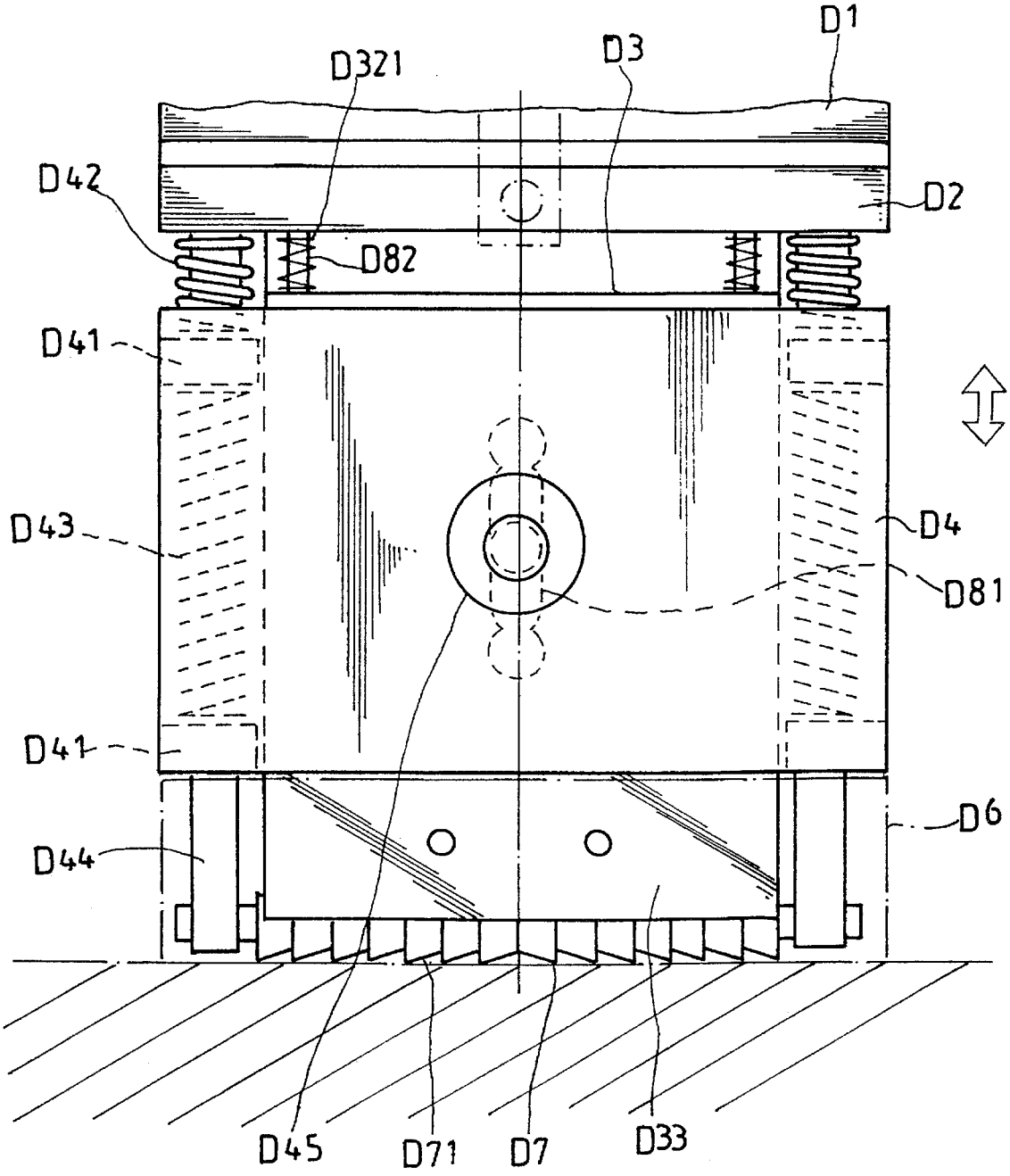
FIG. 16 is a front view of the scrapper carrier according to the present invention.
Figure 17:
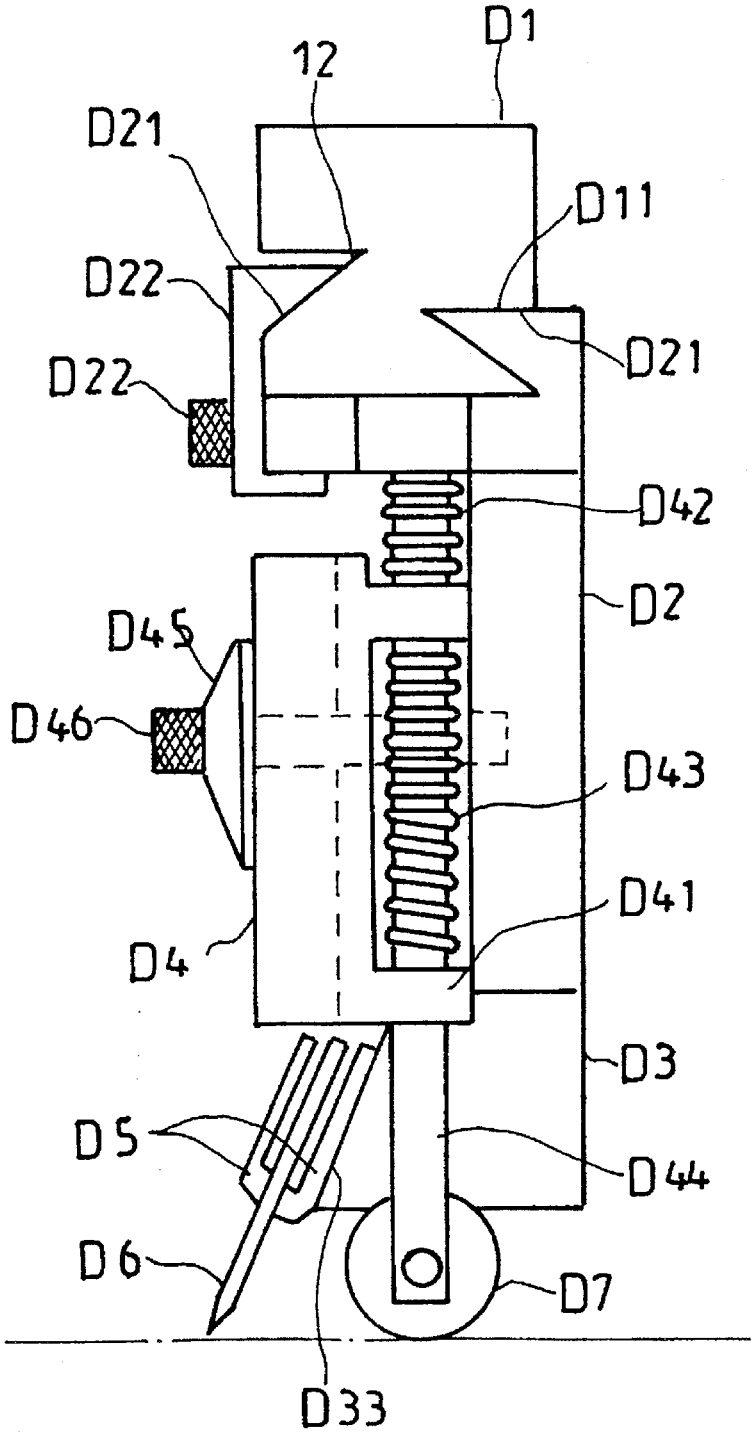
FIG. 17 is a right side view of the scrapper carrier according to the present invention.
Figure 18:
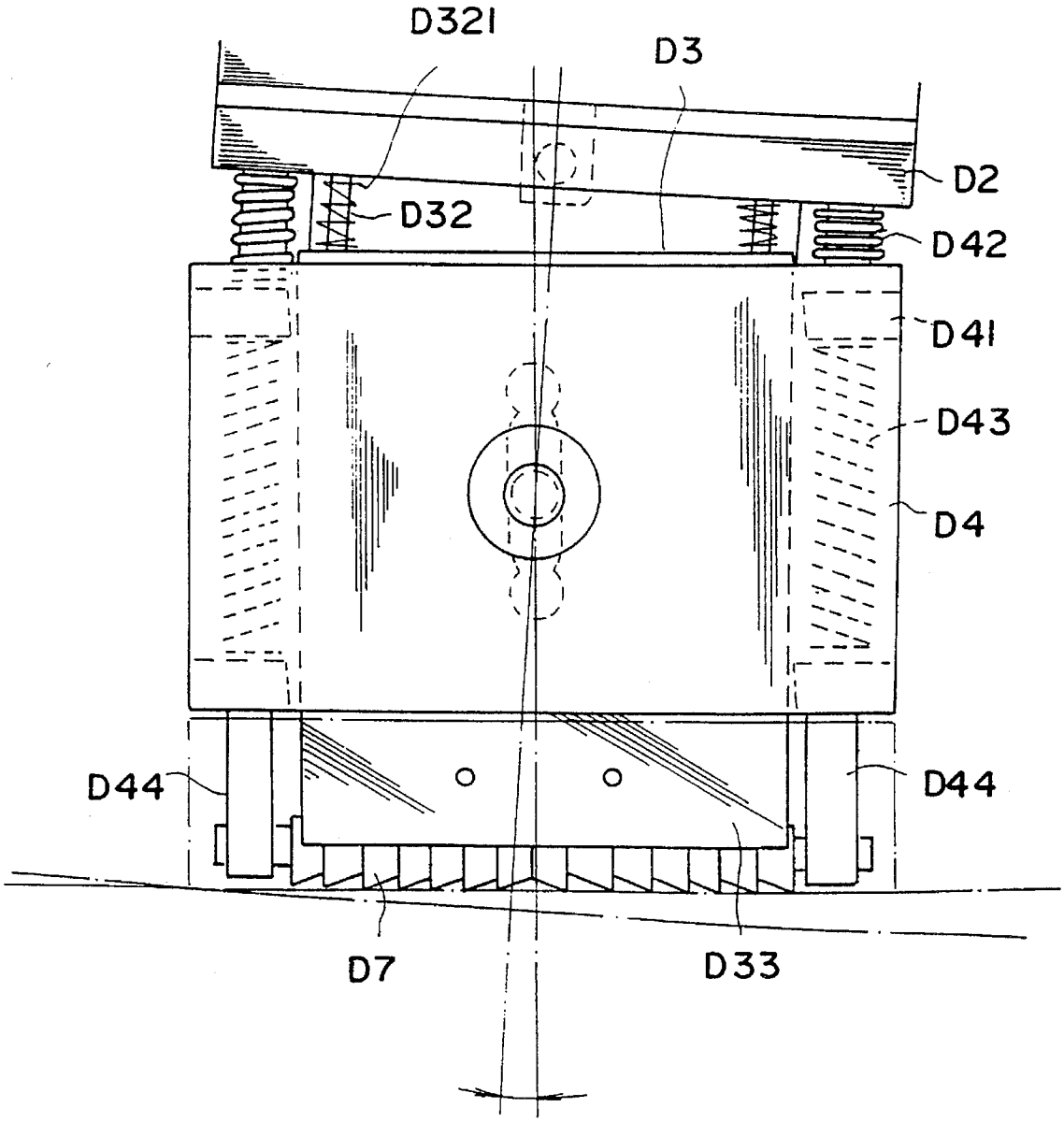
FIG. 18 is similar to FIG. 16 but showing the rack oscillated.

Referring to FIGS. 16, 17, and 18, as indicated, the scraper blade holder plates D5 with the scraper blade D6 are fixedly secured to the downward sloping wall D33 of the rack D3 and the compression springs D321 are supported between the rack D3 and the supporting plate D2; the U-shaped bar D44 and the ink application roller unit D7 are coupled to the cover plate D4 and the compression springs D42 are supported between the cover plate D4 and the supporting plate D2. Therefore, when the stamping plate (not shown) is tilted during the operation of the stamping machine, the rack D3 will be relatively tilted to let the scraper blade D6 and the ink application roller unit D7 be operated at the same elevation.

Figure 19:
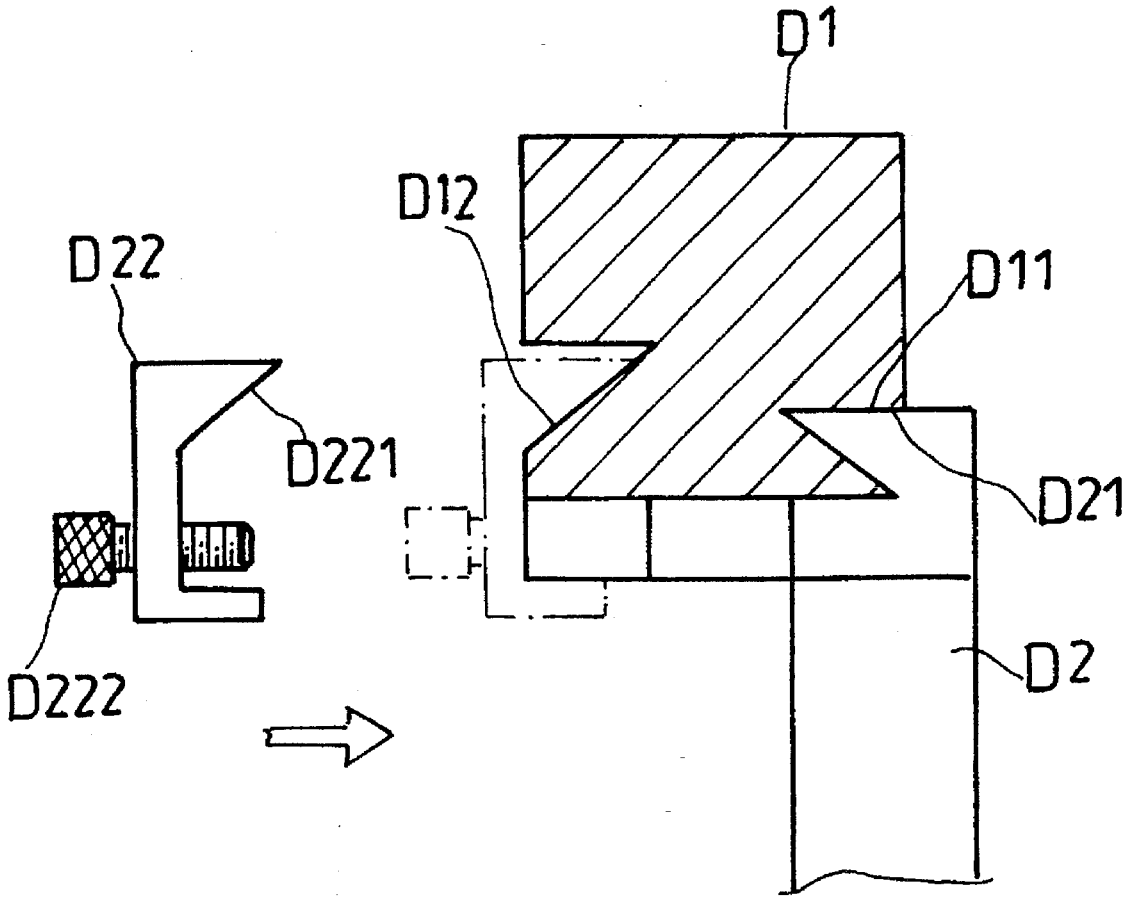
FIG. 19 is a partial view in section of the scrapper carrier according to the present invention, showing the positions of the supporting plate and the locating block relative to the sliding block.
Figure 21:
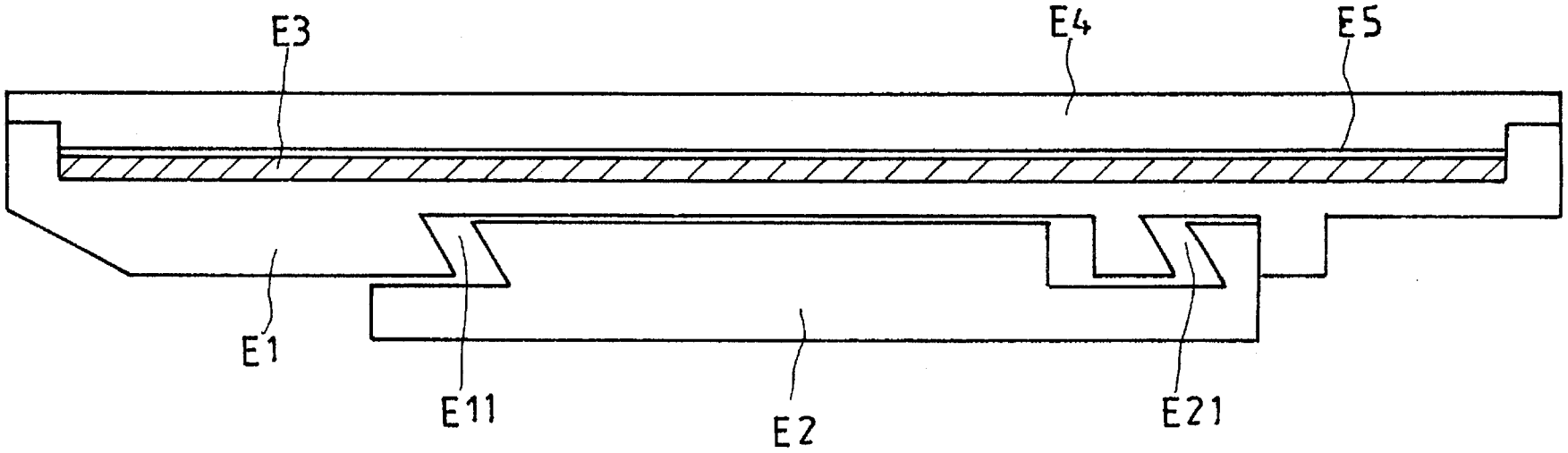
FIG. 21 is a sectional assembly view of the ink tray assembly shown in FIG. 20.

Referring to FIG. 19, the second dovetail groove D12 is at a higher elevation than the first dovetail groove D11, the installation of the locating block D22, which secures the supporting plate D2 to the sliding block D1, does not hinder the installation of the cover plate D4, and allows the rack D3 to be tilted relative to the cover plate D4.

Figure 20:
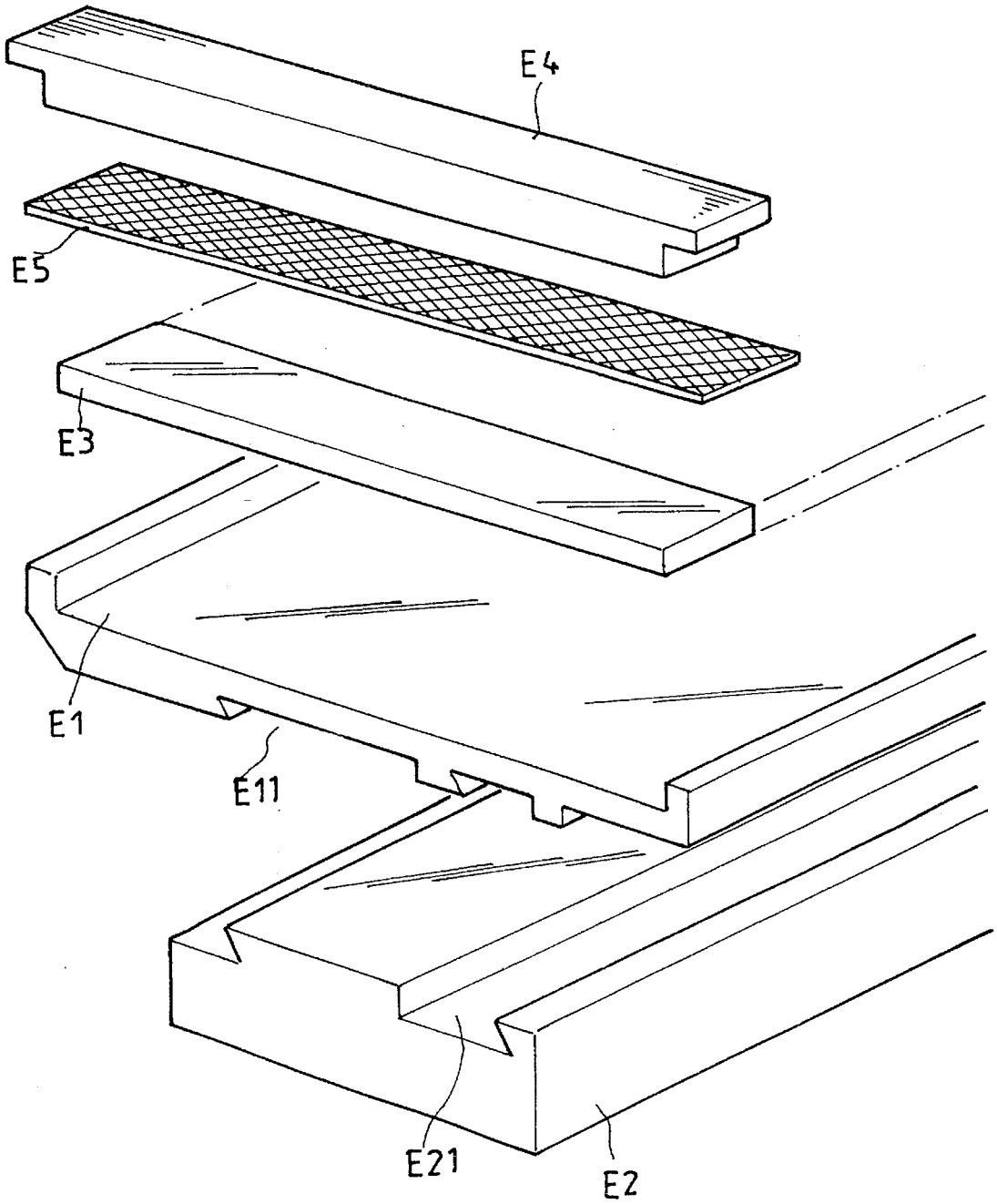
FIG. 20 is an exploded view of the ink tray assembly according to the present invention.
Figure 22:
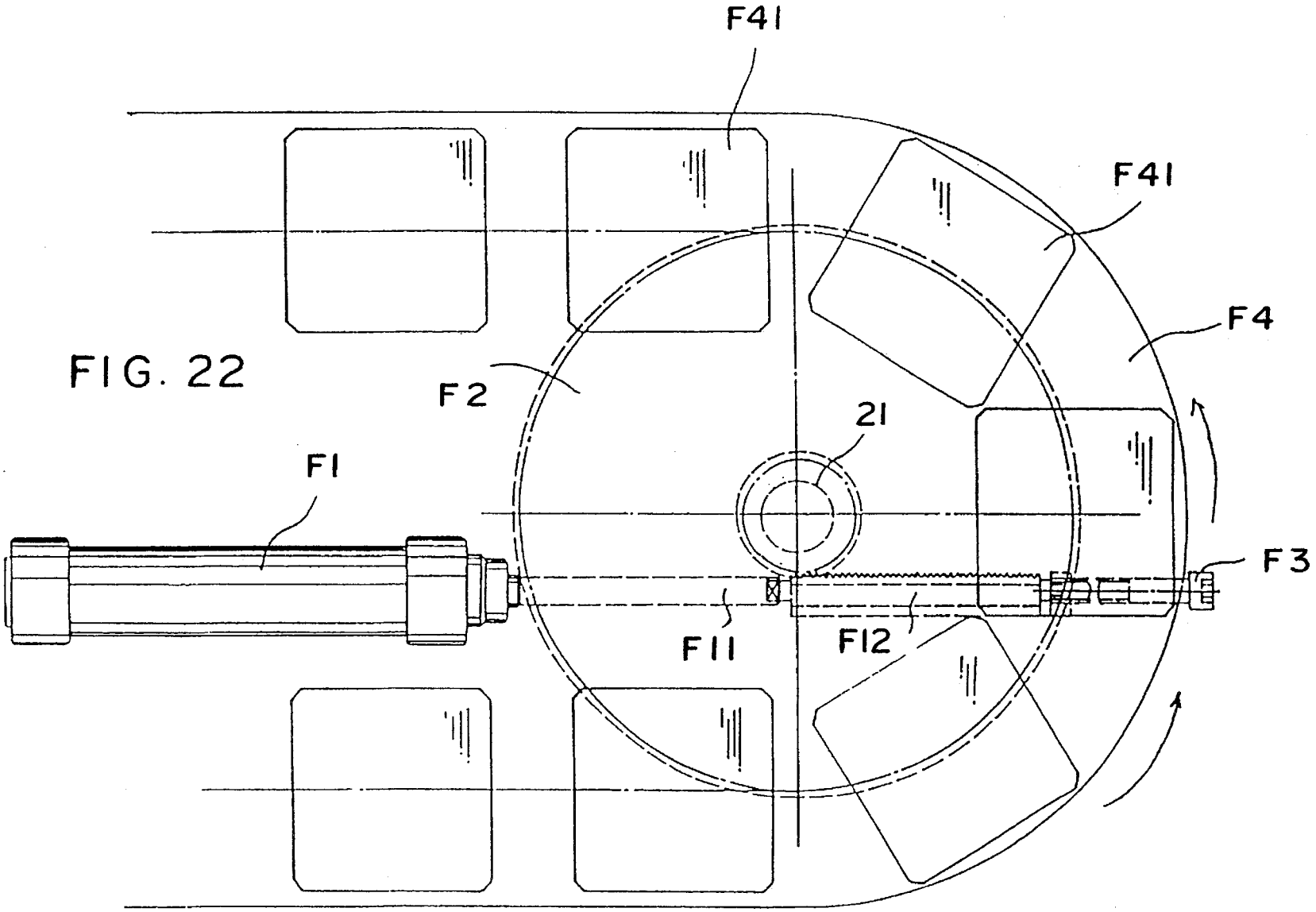
FIG. 22 is a top view of the workpiece conveying mechanism according to the present invention.
Figure 23:
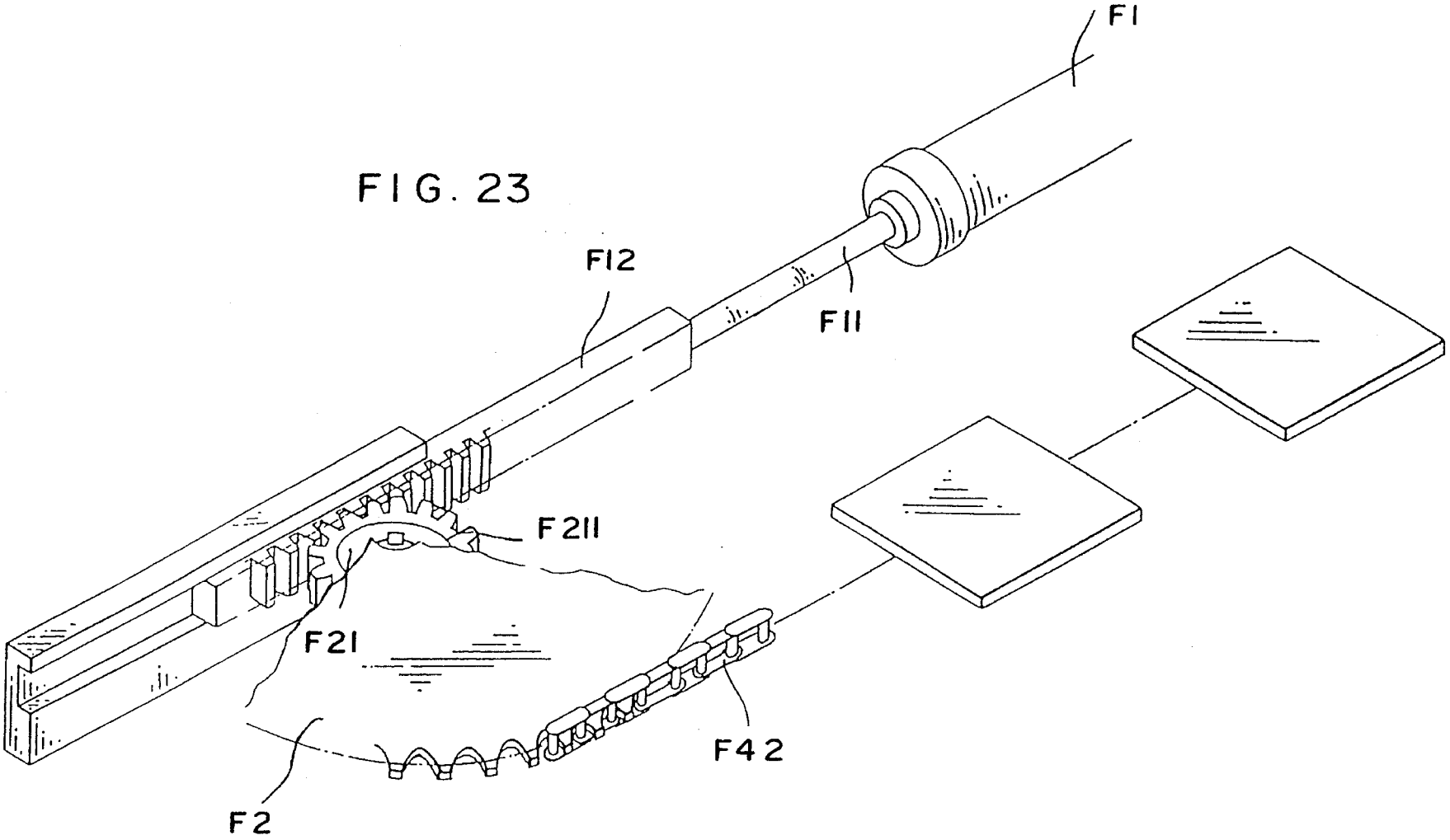
FIG. 23 is a perspective view of the workpiece conveying mechanism shown in FIG. 22.

Referring to FIG. 20, the aforesaid ink tray assembly E comprises a base plate E2, an ink tray E1 fastened to the base plate E2 by a dovetail halved joint E21 and E11 and then fixed in place by a tightening-up screw (not shown), a steel plate E3 covered on the tray E1, a rubber sheet E5 mounted on the steel plate E3, and a metal locating bar E4 mounted on the rubber sheet E5. This structure of ink tray assembly E achieves various advantages including (a) the ink tray E1 being detachable from the base plate E2 because it is fastened to the base plate E2 by a dovetail halved joint; (b) the ink tray E1 being free from vibration after its installation in the base plate E2 and convenient for a replacement; (c) the design of the ink tray E2 permitting the scrapper carrier to be conveniently dismantled, and prohibiting splashing of ink because it is a think, flat member for holding a small amount of ink; (d) the ink tray E1 being prohibited from tilting because it is held down by the steel plate E3 and the metal locating bar E4.

Referring to FIGS. 22, 23, 24A, and 24B, the aforesaid workpiece conveying mechanism F comprises a chain conveyer F4. The chain conveyer F4 comprises a conveying chain F42, a series of equally spaced work table plates F41 mounted on the chain conveyer F42, a driving wheel F2 rotated to turn the conveying chain F42, an air cylinder F1 having a piston rod F11, a rack F12 reciprocated by the piston rod F11 of the air cylinder F1, an one-way bearing F21 fastened to the center of the driving wheel F2 at the bottom side, a gear F211 mounted on the one-way bearing F21 and meshed with the rack F12, and an adjustment screw F3 disposed in front of the rack F12. When the rack F12 is moved forwards by the piston rod F11 of the air cylinder F1 to stop against the adjustment screw F3, the adjustment screw F3 can be threaded forwards or backwards to adjust the turning angle of the driving wheel F2 (the reciprocating distance of the rack F12). When the rack F12 is moved backwards from the adjustment screw F3, the gear F211 is turned by the rack F12 relative to the one-way bearing F21, therefore the driving wheel F2 does no work.

It is to be understood that the drawings are designed for purposes of illustration only, and are not intended as a definition of the limits and scope of the invention disclosed.

I claim:

1. A rubber stamping head angular position adjustment mechanism for a stamping machine, comprising:

a base plate, said base plate comprising a flat rectangular top recess at a front side thereof, two horizontal screw holes on a vertical side wall of said flat rectangular top recess, a U-shaped top recess disposed between said horizontal screw holes in communication with said flat rectangular top recess, a groove on the periphery of said U-shaped top recess, a round hole at the center of said U-shaped top recess, a pin hole disposed at one lateral side thereof perpendicularly through the groove, and a pin inserted into said pin hole;

an universal joint mounted in the U-shaped top recess of said base plate, said universal joint comprising an annular bearing fitted into the groove of said base plate and a ball turned within said annular bearing, said annular bearing having a side notch, which receives the pin of said base plate, said ball having a side notch, which aligns with the side notch of said annular bearing and receives the pin of said base plate, and an axle hole;

a rubber stamping head having a shank inserted through the axle hole of said ball into the round hole of the U-shaped top recess of said base plate; and a locating bar mounted in the flat rectangular top recess of said base plate to hold down the annular bearing of said universal joint in the U-shaped top recess of said base plate, said locating bar having a plurality of through holes respectively fastened to the screw holes of said base plate by a respective screw.

2. The rubber stamping head angular position adjustment mechanism of claim 1 wherein said locating bar has a circularly arched recess at a back side thereof fitting the periphery of the annular bearing of said universal joint.

3. The rubber stamping head angular position adjustment mechanism of claim 1 wherein the U-shaped top recess of said base plate has a flat bottom side flush with the flat rectangular top recess of said base plate.

4. A horizontal slide adjustment mechanism for a stamping machine, comprising two horizontal parallel rails, a rubber stamping head slide mounted on said horizontal parallel rails to carry a rubber stamping head angular position adjustment mechanism, an air cylinder controlled to reciprocate said rubber stamping head slide on said horizontal parallel rails, a stroke control block mounted on said horizontal parallel rails, a screw rod fastened to said stroke control block and extended out of the stamping machine, a hand wheel coupled to said screw rod for turning it to move said stroke control block along said horizontal parallel rails, said stroke control block comprising two notches respectively extended to said horizontal parallel rails, two holding-down handles respectively connected to said notches and turned to lock said stroke control block in position, and a stop bar mounted with a micro-switch, said micro-switch being triggered to stop said air cylinder when it is touched by said rubber stamping head slide micro-switch.

* * * * *